United States Patent [19]

Sumiyoshi

[11] 4,044,735

[45] Aug. 30, 1977

[54] EXHAUST GAS RECIRCULATION VALVE

[75] Inventor: Masaharu Sumiyoshi, Toyota, Japan

[73] Assignee: Toyota Jidosha Kogyo Kabushiki Kaisha, Toyota, Japan

[21] Appl. No.: 659,954

[22] Filed: Feb. 20, 1976

[30] Foreign Application Priority Data

Oct. 22, 1975 Japan ..... 50-127106

[51] Int. Cl.[2] ..... F02M 25/06

[52] U.S. Cl. ..... 123/119 A; 137/505.13; 137/510

[58] Field of Search ..... 123/119 A; 251/61.1, 251/61.4; 137/505.13, 510

[56] References Cited

U.S. PATENT DOCUMENTS

| | | | |
|---|---|---|---|
| 3,144,044 | 8/1964 | Anthes | 137/510 X |
| 3,799,131 | 3/1974 | Bolton | 123/119 A |
| 3,802,402 | 4/1974 | Swatman | 123/119 A |
| 3,834,363 | 9/1974 | Goto et al. | 123/119 A |
| 3,844,261 | 10/1974 | Garcea | 123/119 A |
| 3,929,148 | 12/1975 | Midy | 137/82 X |

*Primary Examiner*—Alan Cohan
*Assistant Examiner*—Gerald A. Michalsky
*Attorney, Agent, or Firm*—Birch, Stewart, Kolasch & Birch

[57] ABSTRACT

An exhaust gas recirculation valve comprising a back pressure control chamber connected with the exhaust pipe of an internal combustion engine via a throttling means, a membrane which constitutes a part of the wall defining said back pressure control chamber, the outside surface of said membrane being exposed to the atmospheric pressure while the inside surface of said membrane being closely opposed by an open end of a gas outlet tube so that said membrane and said open end constitute a valve structure for controlling the exhaust gas flow through the exhaust gas recirculation valve.

4 Claims, 4 Drawing Figures

EXHAUST GAS RECIRCULATION VALVE

BACKGROUND OF THE INVENTION

1. Field of the Invention

The present invention relates to the exhaust gas recirculation system (EGR System) for an internal combustion engine and, more particularly, an exhaust gas recirculation valve (EGR Valve) for controlling the amount of exhaust gas recirculated through the exhaust gas recirculation system.

2. Description of the Prior Art

It is known to be effective for reducing the emission of nitrogen oxide (NOx) from internal combustion engines that a part of the exhaust gas is recirculated to the intake air. In order to obtain the optimum effect of the exhaust gas recirculation in view of the overall performance of an internal combustion engine, it is considered favorable that the ratio of the amount of exhaust gas recirculated to the total amount of gas, i.e., the exhaust gas recirculation ratio, is constantly maintained at a predetermined value. In order to accomplish a constant exhaust gas recirculation ratio, a region is provided in the route of the exhaust gas recirculation extending from the exhaust pipe of an engine to the intake tube thereof, said region being constantly maintained at atmospheric pressure, wherein a throttling means of a predetermined throttling ratio is provided at the entrance of said particular region. Several examples of an exhaust gas recirculation valve based upon the abovementioned principle so as to accomplish a constant exhaust gas recirculation ratio are disclosed, for example, in Japanese Patent Application 35241/72, U.S. Pat. No. 3799131 and U.S. Pat. No. 3802402. However these conventional exhaust gas recirculation valves have relatively complicated structures and, furthermore, since in these valves the exhaust gas flow is controlled by a conventional valve element-valve seat structure, there is a drawback in that the tight contact between the valve element and the valve seat is obstructed by small particles contained in the exhaust gas, thereby resulting in an inaccurate control of the exhaust gas flow. Furthermore, since the valve element is movably supported by a valve stem which in turn is slidably supported by a guide means, the small particles contained in the exhaust gas also enter into the space between the valve stem and the guide means thereby obstructing smooth operation of the valve element.

SUMMARY OF THE INVENTION

It is the object of the present invention to remove the abovementioned drawbacks by providing an exhaust gas recirculation valve of a very simple structure wherein, however, a constant exhaust gas recirculation ratio is positively maintained based upon the aforementioned principle.

Other objects and futher scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

According to the present invention, the abovementioned object is accomplished by an exhaust gas recirculation valve comprising a back pressure control chamber connected with the exhaust pipe of an internal combustion engine via a throttling means, a membrane which constitutes a part of the wall defining said back pressure control chamber, the outer surface of said membrane facing opposite to the inside of said chamber and being exposed to atmospheric pressure, and a gas outlet tube having an open end positioned to closely oppose the inside surface of said membrane facing the inside of said chamber, the opening of said open end being controlled by said membrane, wherein the ratio of the opening area of said open end to effective pressure response area of said membrane is substantially smaller than 1.

BRIEF DESCRIPTION OF THE DRAWING

The present invention will become more fully understood from the detailed description given hereinbelow and the accompanying drawings which are given by way of illustration only, and thus are not limitative of the present invention, and wherein, FIG. 1 is a view schemmatically showing the basic structure of the cxhaust gas recirculation valve of the present invention together with an exhaust gas recirculation system; and, FIGS. 2–4 show an embodiment of the exhaust gas recirculation valve of the present invention in more detail, wherein

DESCRIPTION OF THE PREFERRED EMBODIMENT

Figure 1:
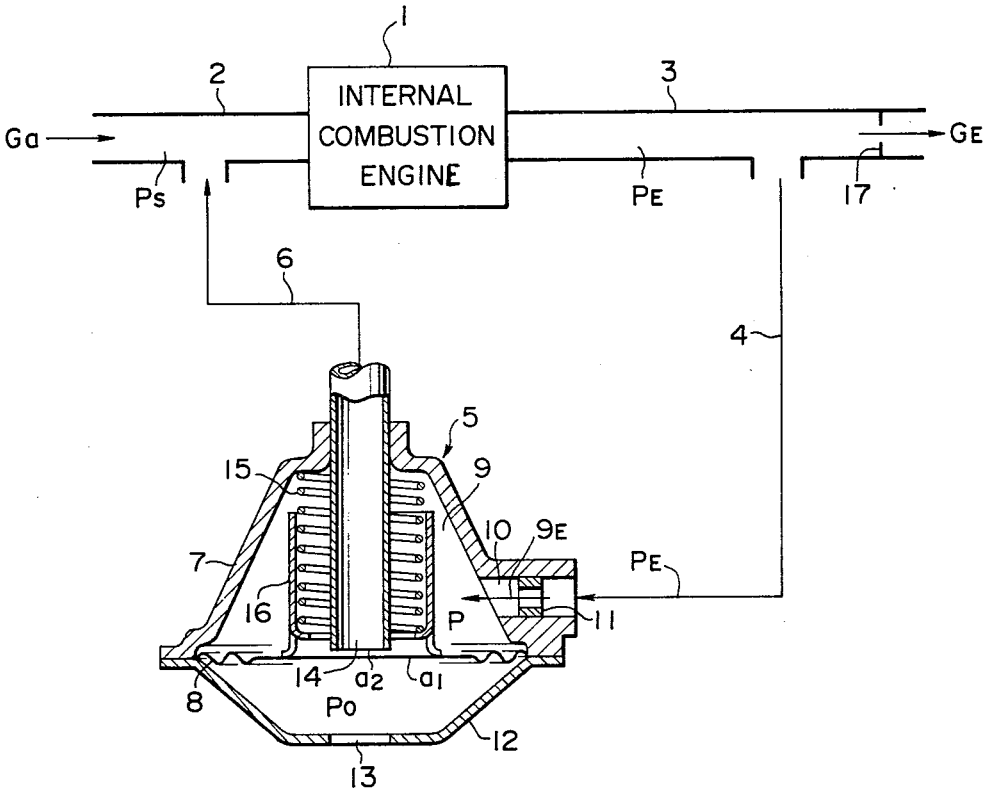

Referring to the drawing, an internal combustion engine 1 diagrammatically shown in FIG. 1 takes in air or fuel-air mixture through an intake tube 2 and discharges exhaust gases through an exhaust pipe 3. An exhaust gas branch pipe 4 is branched from the exhaust pipe 3 and is connected to the exhaust gas recirculation valve of the present invention generally designated by 5. A gas outlet tube 6 having one end thereof incorporated within the exhaust gas recirculation valve extends from the valve and is connected to the intake tube 2 at the other end thereof. Thus, an exhaust gas recirculation system including the exhaust gas branch pipe 4, the exhaust gas recirculation valve 5 and the exhaust gas outlet tube 6 is established.

The exhaust gas recirculation valve 5 comprises a vessel-like housing 7 and a membrane 8 which closes the open end of said housing thereby defining a back pressure control chamber 9. The chamber 9 is provided with an exhaust gas inlet port 10 which is connected with the exhaust gas branch pipe 4 though a throttling means like an orifice 11 so as to be supplied with the exhaust gas separated from the exhaust gas flow in the exhaust pipe 3. A protective housing 12 is provided to cover the membrane 8. However, the protective housing has an opening or openings 13 so that the outer surface of the membrane 8 facing opposite to the inside of said back pressure control chamber 9 is constantly exposed to the atmospheric pressure. Within the back pressure control chamber 9 an open end 14 of the exhaust gas outlet tube 6 is positioned to closely oppose a central portion of said inside surface of the membrane 8. The open end of the tube 6 has a flat end face positioned substantially parallel to the flat central portion of the membrane 8 so that when the central portion of the membrane contacts the open end 14 of the exhaust gas outlet tube, the open end is closed. In this manner, the opening of the open end 14 of the exhaust gas outlet tube is controlled by the membrane 8. As explained in detail hereinunder, the central portion of the membrane 8 is applied with a light downward spring force as seen in the figure by a compression coil spring 15. In other words, the central portion of the membrane 8 is applied with a resilient force which removes the central portion from the open end 14 of the gas outlet tube 6. Element 16 designates a retainer for the compression coil spring 15.

In the following, the operation of the exhaust gas recirculation valve 5 is explained.

Denoting the exhaust gas flow by $G_E$ and substituting the throttling action effected by a muffler, etc. provided at an outlet portion of the exhaust pipe by that of an equivalent orifice 17 having flow coefficient $C_1$ and flow area A, the relation between the exhaust gas pressure $P_E$ and the atmospheric pressure $P_O$ is given by the following equation:

$$G_E = C_1 A \sqrt{P_E - P_o} \quad (1)$$

The amount of exhaust gas $g_E$ recirculated through the branch pipe 4 ia determined from the pressure P in the back pressure control chamber 9, flow coefficient $C_2$ of the orifice 11 and flow area a of said orifice:

$$g_E = C_2 a \sqrt{P_E - P} \quad (2)$$

Therefore, if P is constantly maintained at $P_O$, the condition of $g_E/G_E = C_2 a/C_1 A$ = constant is maintained regartless of the operating condition of the engine, thus maintaining a constant exhaust gas recirculation ratio.

Referring now to the exhaust gas recirculation valve 5, assuming that the central portion of the membrane 8 is positioned very close to the open end 14 of the gas outlet tube 6, by denoting the suction pressure in the intake tube 2 by $P_S$, effective pressure responsive area of the membrane 8 by $a_1$, effective sectional area of said open end 14 by $a_2$ and the spring force which the compression coil spring 15 applies to the membrane 8 in this condition by F, the following equation is established:

$$a_1 P_O = (a_1 - a_2) P + a_2 P_S + F = a_1 P - a_2 (P - P_S) + F \quad (3)$$

In this case, the restoring force of the membrane 8 is assumed to be very small and negligible. All pressures are expressed by the absolute scale.

The suction pressure $P_S$ generally fluctuates within the range 1–0.2 atmospheric pressure in an ordinary internal combustion engine. With respect to areas $a_1$ and $a_2$, if, for example, the diameter of the effective sectional area of the open end 14 of the gas outlet tube 6 is one seventh of the diameter of the effective pressure responsive surface of the membrane 8, $a_2$ is one forty-ninth of $a_1$. Therefore, the magnitude of term $a_2 \times (P - P_S)$ is so small when compared with term $a_1$ P that it can be disregarded. As mentioned above, since the spring force of the compression coil spring 15 is designed to be weak, term F can be disregarded when compared with term $a_1$ P. Therefore, the equation (3) can be approximately reduced to:

$$a_1 P_O \approx a_1 P \quad (4)$$
$$P \approx P_o \quad (5)$$

This means that the pressure P in the back pressure control chamber 9 is constantly maintained at the atmospheric pressure. Based upon this condition, the equation (2) can be rewritten as follows:

$$g_E \approx C_2 a \sqrt{P_E - P_o} \quad (2)'$$

Thus, the ratio of the recirculation gas flow $g_E$ to the exhaust gas flow $G_E$ is maintained to be substantially constant.

In a qualitative manner, the operation of the exhaust gas recirculation valve 5 is explained as follows. Assuming that the gas existing in the back pressure control chamber 9 is inhaled by the vacuum in the intake tube 2 thereby lowering the pressure P below the atmospheric pressure $P_o$, the membrane 8 is urged upward as seen in FIG. 1 due to a relatively larger force applied to its lower surface when compared with the force applied to its upper surface. Therefore, the central portion of the membrane approaches to the open end 14 and reduces the cross sectional area of the annular passage which connects the inside space of the back pressure control chamber 9 and the passage defined in the gas outlet tube 6. Therefore, the exhaust gas flow passing through the annular passage is correspondingly reduced. If the exhaust gas flow from the back pressure control chamber 9 to the exhaust gas outlet tube 6 reduces, an accumulation occurs with respect to the exhaust gas flowing into the back pressure control chamber 9 through the orifice 11, whereby the pressure P in the back pressure control chamber 9 increases to be restored toward the atmospheric pressure $P_O$. On the other hand, if the pressure P in the back pressure control chamber 9 has increased beyond the atmospheric pressure $P_O$ due to a larger amount of exhaust gas inflow, the membrane 8 is urged downward due to a relatively larger force applied to its upper surface when compared with that applied to its lower surface, whereby the central portion of the membrane is removed from the open end 14 and increases the cross sectional area of the annular passage connecting the back pressure control chamber 9 to the gas outlet tube 6. Therefore, the gas flow from the back pressure control chamber 9 to the exhaust gas outlet tube 6 increases thereby reducing the accumulation of exhaust gas within the back pressure control chamber 9. Thus, the pressure P in the back pressure control chamber 9 lowers toward the atmospheric pressure $P_O$. In this manner, the pressure P in the back pressure control chamber 9 is automatically controlled toward the target value of atmospheric pressue $P_O$.

It will be appreciated that since the exhaust gas recirculation valve of the present invention employs cooperation of the membrane 8 and the open end 14 of the gas outlet tube for controlling the flow of exhaust gas and does not include the valve stem and valve guide as in the conventional EGR valve, it is free from the trouble that the small particles contained in the exhaust gas attach to the valve stem and cause a dull sliding action or sticking of the valve stem. Furthermore, since the clearance between the membrane 8 and the open end 14 of the gas outlet tube is very narrow and the membrane 8 reciprocates very quickly in a manner of almost vibrating to open or close the open end 14, the exhaust gas flow traverses said clearance very quickly thereby blowing off small particles which intend to attach to said open end. Therefore, the danger that the membrane sticks to the open end 14 or the control of the recirculating gas flow becomes inaccurate is positively avoided.

Figure 2:
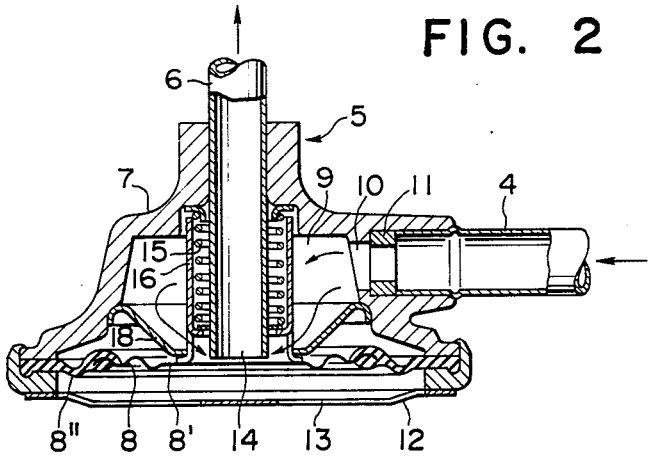
FIG. 2 is a longitudinal section.
Figure 3:
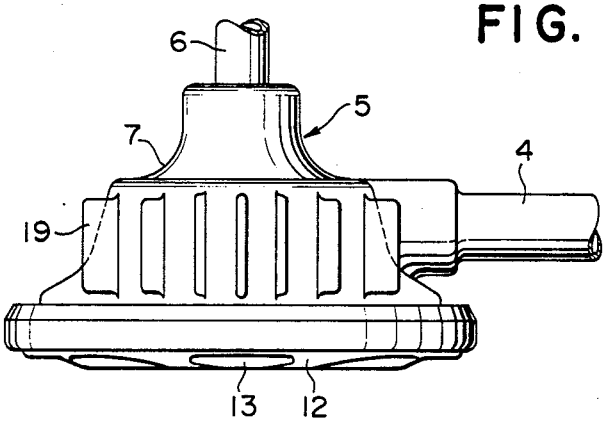
FIG. 3 is a side view and FIG. 4 is a bottom view.
Figure 4:
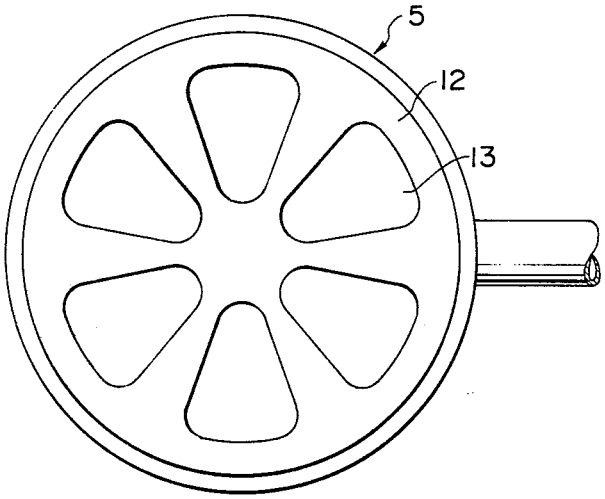

FIGS. 2–4 show an embodiment of the exhaust gas recirculation valve according to the present invention in more detail. FIG. 2 is a view similar to FIG. 1 showing a longitudinal section of the exhaust gas recirculation valve 5. In FIG. 2, the portions corresponding to those shown in FIG. 1 are designated by the same reference numerals.

In the embodiment shown in FIG. 2, the membrane 8 comprises a central portion 8' made of a thin sheet of stainless steel and an annular peripheral portion 8'' made of heat resistive rubber, these two portions being joined by, for example, baking. By forming the peripheral portion of the membrane by a soft material like the heat resistive rubber, the spring coefficient of the membrane 8 is made substantially zero, whereby the aforementioned equation (3) is more correctly established. In relation to the structure of forming the peripheral portion of the membrane 8 by the heat resistive rubber material, the embodiment shown in FIG. 2 comprises a funnel-like guide means 18 which operates to guide relatively hot exhaust gas flow introduced into the back pressure control chamber 9 from the port 10 directly toward the open end 14 of the gas outlet tube 6 without causing direct contact between the hot gas and the annular peripheral portion 8'' made of rubber. Similarly, the retainer 16 for the compression coil spring 15 is made of a cylindrical element which prevents direct contact between the hot exhaust gas and the compression coil spring 15 so that the spring performance of the coil spring is not thermally effected.

As shown in FIG. 3, radiation fins 19 may be provided at the outside of the housing 7 so that heating up of the exhaust gas recirculation valve up to an unfavorable temperature is avoided.

As shown in FIG. 4, the membrane protecting housing 12 may preferably be provided with a plurality of openings 13 so that a large opening area is available. This structure having a plurality of openings provides for a good ventilation and cooling of the membrane 8 without losing the function of protecting the membrane.

From the foregoing, it will be appreciated that the present invention provides a gas recirculation valve which has a very simple structure and yet is able to constantly maintain a predetermined constant exhaust gas recirculation ratio.

I claim:

1. An exhaust gas recirculation valve comprising a housing which contains a back pressure control chamber provided with a gas inlet port connected with an exhaust pipe of an internal combustion engine via a throttling means, a membrane means including a central metal sheet member and an annular peripheral rubber sheet member, said membrane means forming a part of the wall defining said back pressure control chamber, the outer surface of said membrane which faces opposite to the inside of said chamber being exposed to atmospheric pressure, a gas outlet tube supported by said housing and having an open end positioned to closely oppose a central portion of the inside surface of said membrane means which faces the inside of said chamber, the opening of said open end of said gas outlet tube being controlled by said membrane means, a funnel means adapted to guide gases from said gas inlet port towards said central portion of said membrane means, an annular spring retainer supported on said central portion of said membrane means, and a coil spring located around said gas outlet tube and supported between said spring retainer and said housing, wherein the ratio of the opening area of said open end of said gas outlet tube to an effective pressure responsive area of said membrane means is substantially smaller than 1.

2. The valve of claim 1, wherein a perforated protective housing is provided to cover said membrane.

3. The valve of claim 1, wherein said membrane is a circular element having effective pressure responsive surface of a first diameter and said open end has a circular effective cross section of a second diameter, the ratio of said first diameter to said second diameter being approximately 7.

4. The exhaust gas recirculation valve of claim 1, wherein the outside of the housing is provided with a plurality of radiation fins so that the heating-up of the exhaust gas recirculation valve is avoided.

* * * * *